US005605425A

United States Patent [19]

Schaefer

[11] Patent Number: 5,605,425

[45] Date of Patent: Feb. 25, 1997

[54] THREE PIECE TAPE BOUND HARD COVER BOOKS

[75] Inventor: Barbara J. Schaefer, Rochester, N.Y.

[73] Assignee: Xerox Corporation, Stamford, Conn.

[21] Appl. No.: 430,022

[22] Filed: Apr. 27, 1995

[51] Int. Cl.[6] ..... B42C 11/00

[52] U.S. Cl. ..... 412/4; 412/8; 412/36; 412/902

[58] Field of Search ..... 412/1, 4, 8, 19, 412/36, 37

[56] References Cited

U.S. PATENT DOCUMENTS

| | | | |
|---|---|---|---|
| 3,749,423 | 7/1973 | Abildgaard et al. | 281/21 |
| 3,804,694 | 4/1974 | Blair | 412/36 X |
| 4,091,487 | 5/1978 | Axelrod | 11/1 AD |
| 5,026,236 | 6/1991 | Otake et al. | 412/8 X |
| 5,052,873 | 10/1991 | Parker et al. | 412/36 X |

*Primary Examiner*—Willmon Fridie, Jr.
*Attorney, Agent, or Firm*—William A. Henry, II

[57] ABSTRACT

A method for assembling hard cover books with a tape bound cover includes the steps of: providing front and rear hard covers; placing a book block between the front and rear covers; adhering a flexible spine member having an adhesive on one surface thereof to the front and rear hard covers and spine portion of the book block; and adhering an inner leaf sheet to inside surfaces of the front and rear hard covers and outside surfaces of the book block, thereby completing a bound hard cover book.

2 Claims, 3 Drawing Sheets

THREE PIECE TAPE BOUND HARD COVER BOOKS

BACKGROUND OF THE INVENTION

This invention is directed generally to the binding of books, and in particular is concerned with a method in which front and back covers are secured to book blocks in creating a case bound book.

Sheet binding is one of the oldest known arts, and numerous methods and apparatuses are known in the art for permanently or temporarily securing sheets together. Many of these, of course, are only economically suited for high priced or high volume commercial printing operations. There is a long standing need for a book binding means adapted for localized, simple and inexpensive creation of books from, for example, short runs of books of 1 to about 100 that are from about 0.24 to about 1.0 inches thick.

This need has been greatly increased by the widespread use of xerographic equipment, where large numbers of printed sheets are produced by relatively unskilled personnel in non-commercial printing operations. There is a need in the finishing industry for an upscale hardback cover look which transforms the utilitarian soft cover type bound copy set into an expensive looking bound book. Attempts have been made in the past at filling this need. For example, in one bindery system, attachment holes must be punched in all pages that are to be placed within hardback covers. This is a slow and tedious process. There is also the substantial cost of the punching and case centering devices. There is a need to move the printing of books from traditional offset to xerography by simplifying the binding methods and enabling binding on demand, on-site at the printshop. Generally, books are offset printed at one location and sent out to be bound.

PRIOR ART STATEMENT

Patents of interest include U.S. Pat. No. 4,091,487 which discloses a method for binding books having a plurality of signatures glued together along a spine. The front and back sheets are of heavier paper stock. A paper cover of the heavier stock having a size to cover three sides of the book is glued to the book and to the entire inside surface of the hardcover. U.S. Pat. No. 3,749,423 is directed to assembling an uncased book to a case. None of these methods and apparatuses appear to answer the heretofore mentioned problem of producing case bound books at the point of printing on demand.

SUMMARY OF THE INVENTION

Accordingly, a cost effective binding method for assembling case bound books on demand is disclosed that includes the steps of: providing front and rear hard covers; placing a book block between said front and rear hard covers; adhering a flexible spine member having an adhesive on one surface thereof to said front and rear hard covers and a spine portion of said book block; and adhering an inner leaf sheet to inside surfaces of said front and rear hard covers and outside surfaces of said book block, thereby completing a bound hard cover book.

Figure 1:
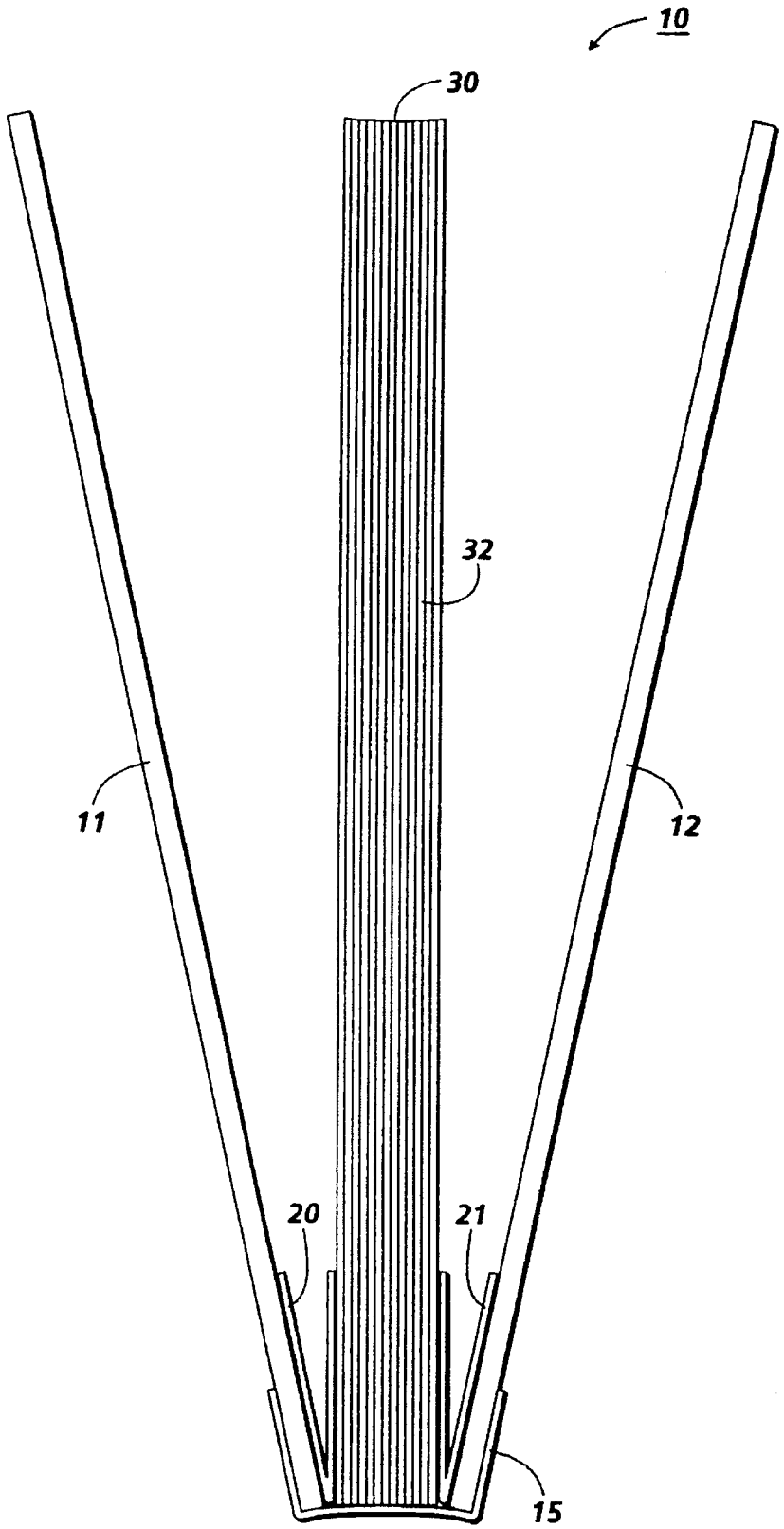
FIG. 1 is a side of a hard cover book created by use of the method of the present invention.
Figure 2A:
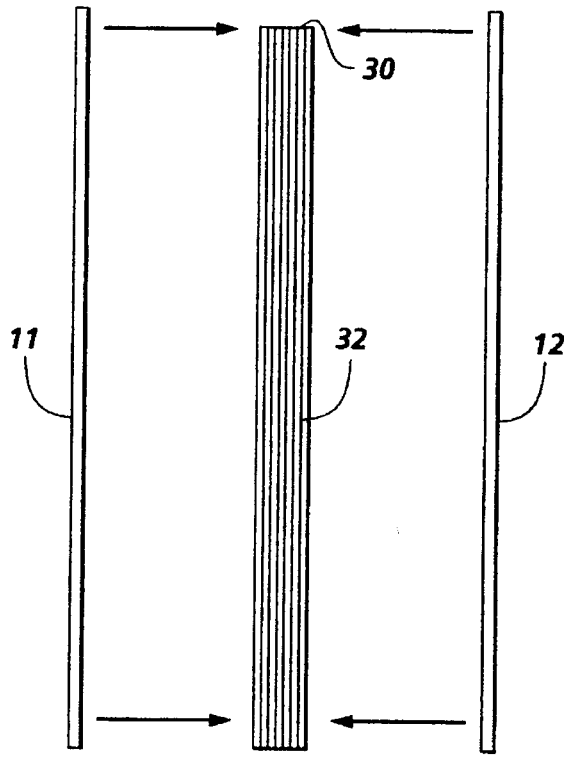
FIGS. 2A–2D show steps in assembling the book of FIG. 1
Figure 2B:
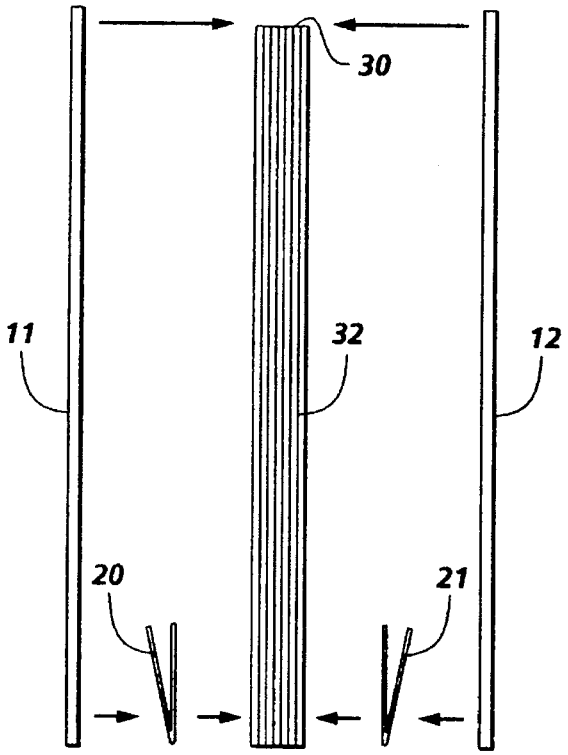
Figure 2C:
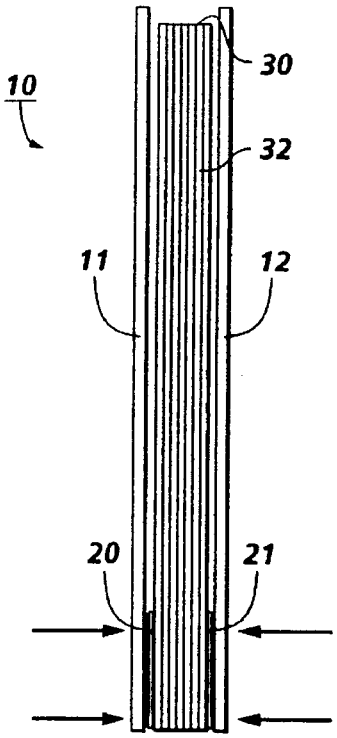
Figure 2D:
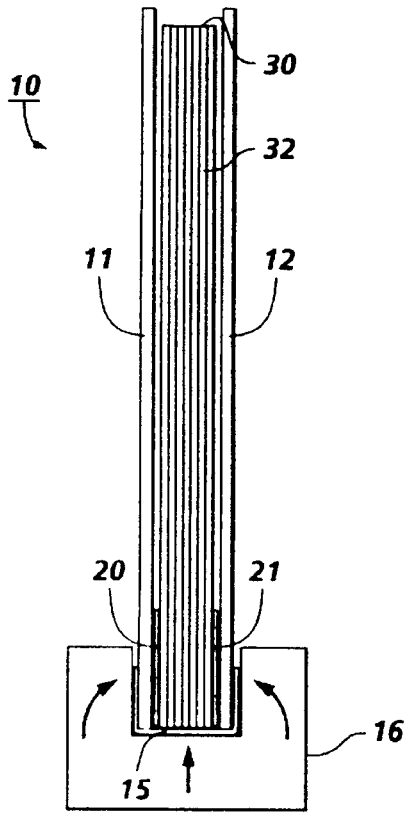

All references cited in this specification, and their references, are incorporated by reference herein where appropriate for teachings of additional or alternative details, features, and/or technical background.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the features of the present invention, reference is made to the drawings. In the drawings like reference numerals have been used throughout to designate identical elements.

Referring to FIG. 1, a hard cover bound book is shown that is assembled with a method that greatly reduces the level of expertise and expense of equipment previously required to assemble a hard case bound book. The hard cover book 10 of FIG. 1 includes front hard cover 11 and rear hard cover 12 and a thermal tape 15 adhesively secured to a bottom portion of each cover with a spine portion therebetween that receives a book body 30 that is adhesively attached to the spine portion of tape 15. Book body 30 includes a block of xerographically or offset printed pages 32. Folded inner leaf sheets 20 and 21 have a pressure sensitive adhesive applied to the outside surface of each that can be covered by a liner (not shown) when not in use. These liners may vary in length depending on whether the outside page of the book block is titled or whether there is a cut-out in the hard cover in the front of the book for viewing of the title or other information. The spine of book body 30 is pressed into engagement with the adhesive on the inner surface of tape 15 and held thereto by the adhesive.

Traditional case binding is expensive, restrictive and impractical for print on demand applications. The method for assembling a hard cover book depicted in FIGS. 2A–2D) answers this need by providing a fast, easy, and inexpensive bind. The book block 30 is trimmed to size and placed between pre-made front and rear covers 11 and 12. Tape 15 with an adhesive on its inside surface and of any color desired is contained within conventional thermal binder 16. A suitable thermal binder is marketed by Powis Parker Company, 830 Isabella Street, Oakland, Calif. 94607-9964 under the name Fastback Thermal Binder. Once the book block with the pages therebetween is placed within the binder tape 15, the tape extends around the spine of the book block and outside a portion of hard covers 11 and 12 to tape bind the assembly when heat is applied thereto by the binder 16. The tape bind allows the pages 32 to round providing a fairly flat opening book. The covers can be traditionally wrapped chipboard, unitized board (colored cardboard), or even plastic. If desired, the covers could come with pressure sensitive inner leaf. An advantage of of this technique is that it will work with any thickness of book (up to 1.5" thick) and existing books can be rebound with the original covers.

It should now be understood that a cost effective method and apparatus for assembling books on demand is provided that presents an operator with a minimum of steps to create a finished, professionally bound book from book blocks and hard cover components. In using the on-demand book assembly apparatus and method, an operator will perform the steps of: (a) providing front and rear covers; (b) placing a book body between the front and rear covers; (c) providing a thermal binding apparatus with a thermal actuable tape therein; (d) placing the composite of steps (a) and (b) into said binder with a spine portion of said composite resting against a portion of said tape, said tape extending around said spine portion of said composite and up a portion of said front and rear covers; and (e) actuating said thermal binding apparatus to apply heat to said tape and thereby bind said tape to said book block and front and rear covers. If desired for appearance and structural purposes, folded end sheets could be placed on both sides of the block of printed pages with the end sheets each including a pressure sensitive adhesive on one side thereof covered by a peelable liner. Structurally, the folded end sheet serve to make the attachment of the book body to the cover more durable and reducing stresses on the first page. The liner would be peeled off the end sheets and the major portion of each end sheet above the fold will be adhered to the inside surfaces of each cover and the portion of the liners below the fold will be adhered to the book block.

While the invention has been described with reference to the method structures shown, it is not confined to the specific details set forth, but is intended to cover such modifications or changes as may come within the scope of the following claims.

What is claimed is:

1. A method of creating a hard cover book on demand, comprising the steps of: (a) providing front and rear covers; (b) placing a book body between the front and rear covers; (c) attaching a folded end sheet having an adhesive on one surface thereof to each of said front and rear covers above the fold and attaching the portion of said end sheets below the fold to said book body; (d) providing a thermal binding apparatus with a thermal actuable tape therein; (e) placing the composite of steps (a) through (c) into said thermal binding apparatus with a spine portion of said composite resting against a portion of said tape, said tape extending around said spine portion of said composite and up a portion of an outside surface of both of said front and rear covers; and (f) actuating said thermal binding apparatus to apply heat to said tape and thereby bind said tape to said spine portion of said composite and front and rear covers.

2. A method for assembling hard cover books with a tape bound spine includes the steps of: providing front and rear hard covers; providing a flexible spine member having an adhesive on one surface thereof; placing a book block between said front and rear covers against the adhesive of the flexible spine member; providing a folded end sheet having an adhesive on one surface thereof and attaching said folded end sheet to each of said front and rear covers above the fold and attaching the portion of said end sheets below the fold to said book block; and adhesively adhering said tape to said book block along a spine portion thereof and to outside surfaces of said front and rear hard covers to thereby complete a three piece book.

* * * * *